US005176528A

United States Patent [19]

Fry et al.

[11] Patent Number: 5,176,528

[45] Date of Patent: Jan. 5, 1993

[54] PIN AND SOCKET ELECTRICAL CONNNECTOR ASSEMBLY

[75] Inventors: Rupert J. Fry, Des Plaines; Thomas J. Lescia, Brookfield; Frank R. Ruffino, Winfield, all of Ill.

[73] Assignee: Molex Incorporated, Lisle, Ill.

[21] Appl. No.: 896,940

[22] Filed: Jun. 11, 1992

[51] Int. Cl.[5] ..... H01R 13/53

[52] U.S. Cl. ..... 439/181; 439/682; 439/924

[58] Field of Search ..... 439/181, 186, 285, 520, 439/581, 682, 924

[56] References Cited

U.S. PATENT DOCUMENTS

| | | | |
|---|---|---|---|
| 2,386,177 | 10/1945 | Andersen | 439/342 X |
| 3,432,795 | 3/1969 | Jayne . | |
| 3,699,501 | 10/1972 | Enright et al. | 439/181 X |
| 4,018,492 | 4/1977 | Eckart . | |
| 4,681,549 | 7/1987 | Peterson | 439/181 |
| 4,734,041 | 3/1988 | Bruchmann et al. | 439/924 X |
| 4,897,055 | 1/1990 | Jurista et al. | 439/924 |

*Primary Examiner*—Larry I. Schwartz
*Assistant Examiner*—Khiem Nguyen
*Attorney, Agent, or Firm*—Stephen Z. Weiss

[57] ABSTRACT

An electrical conenctor assembly includes a pair of mating dielectric housings. A first pin contact is mounted on one of the housings and a first socket contact mateable with the first pin contact is mounted on the other of the housings. The first pin and socket contacts are connected to respective power lines. A second pin contact is mounted on the one housing and is connected directly to the power line of the first pin contact. A second socket contact is mounted on the other housing, mateable with the second pin contact, and is connected directly to the respective power line of the first socket contact. The second pin and socket contacts are configured to make mating electrical engagement with each other before the first pin and socket contacts when the housings are moved toward each other in the mating direction. With this structural combination, deterioration due to electrical arcing is restricted to the second contacts while the integrity of the first contacts is maintained.

3 Claims, 1 Drawing Sheet

PIN AND SOCKET ELECTRICAL CONNNECTOR ASSEMBLY

FIELD OF THE INVENTION

This invention generally relates to the art of electrical connectors and, particularly, to a pin and socket electrical connector assembly wherein pairs of pins are mateable with pairs of sockets, and wherein a pin and socket combination of each pair mates before the other pin and socket combination of each pair to accommodate deterioration due to electrical arcing.

BACKGROUND OF THE INVENTION

Male and female electrical connector assemblies have been used for many years in a variety of applications, wherein a plug or male connector is mateable with a receptacle or female connector. A common type of plug and receptacle connector assembly employs pin and socket contacts or terminals.

A continuing problem with electrical connectors of the character described is the deterioration of the pin and socket contacts due to electrical arcing during mating and unmating thereof. It is too expensive to fabricate entire pin contacts and socket contacts of materials which withstand deterioration due to electrical arcing. Consequently, it has become common to plate the mating surfaces of the contacts with a hard, expensive material, such as an alloy of platinum nickel. Another approach has been to weld carbon discs to the tips of the pin contacts, for instance, to prevent oxidation or other deterioration due to electrical arcing. It would be much more economically feasible if the contacts were fabricated of less expensive materials, such as a brass contact plated with tin, which does give excellent electrical connection characteristics, but such contacts are prone to deteriorate when arcing occurs during mating or unmating of the contacts.

Another approach has been to reduce arcing by placing a current-limiting resistor of a suitable value in a redundant contact arrangement. For instance, in U.S. Pat. No. 4,681,549 to Peterson, dated Jul. 21, 1987, such an approach is disclosed for avoiding arcing between a connection pad of a printed circuit board and a contact of a connector. The pad is terminated before the connection edge of the printed circuit board. The connection is bypassed with a second connection comprising another contact of the connector, another pad of the printed circuit board and a series resistor. Again, as with the expensive plating approach, such a scheme of adding resistors literally can be cost prohibitive in many applications, particularly involving high density connectors.

This invention is directed to solving these problems in a very simple connector assembly wherein each of a pair of power lines is directly wired to a respective pair of mating pin and socket contacts. One pin or socket contact of each pair is configured to initially mate before the other pin or socket of each pair. The pin and socket contacts can be fabricated of relatively inexpensive material, and the first-to-mate pin and socket contact combination can be allowed to deteriorate while the integrity of the other pin and socket combination is maintained. In other words, the first-to-mate pin and socket combination of each pair comprise "sacrificial" contacts.

SUMMARY OF THE INVENTION

An object, therefore, of the invention is to provide a new and improved electrical connector assembly of the pin and socket type, which is designed to overcome the deterioration effects of electrical arcing upon initial mating of the connectors.

In the exemplary embodiment of the invention, an electrical connector assembly includes a pair of mating dielectric housings. A first pin contact is mounted on one of the housings, a first socket contact mateable with the first pin contact is mounted on the other of the housings, and the first pin and socket contacts are connected to respective power lines.

The invention contemplates the provision of a second pin contact mounted on the one housing and connected directly to the power line of the first pin contact. A second socket contact is mounted on the other housing, mateable with the second pin contact, and connected directly to the respective power line of the first socket contact. The second pin and socket contacts are configured to make mating electrical contact with each other before the first pin and socket contacts when the housing are moved toward each other in a mating direction. Therefore, contact deterioration due to electrical arcing is restricted to the second contacts while the integrity of the first contacts is maintained. In essence, the second pin and socket contacts comprise "sacrificial" contacts.

As disclosed herein, the first and second socket contacts are of equal length in the mating direction, and the second pin contact is longer than the first pin contact. All the contacts are crimp-type terminals crimped to respective bifurcated branch portions of the respective power lines so that the contacts are wired directly to the lines.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENTS

Figure 1:
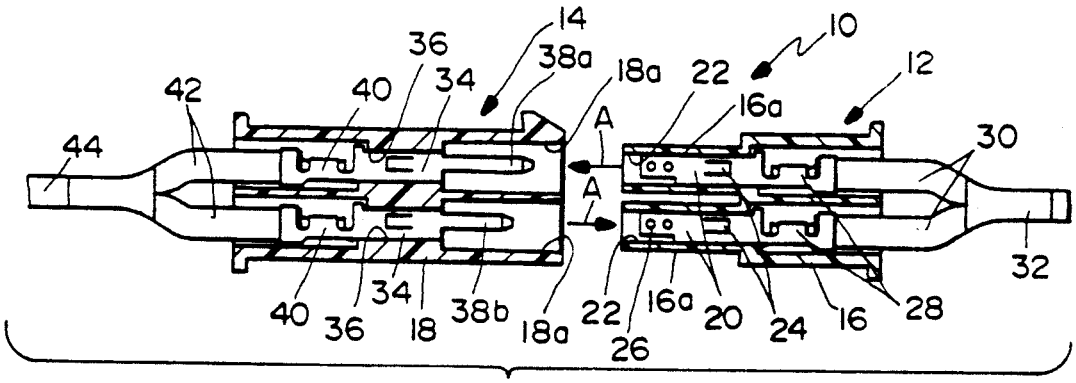
FIG. 1 is an axial section through an electrical connector assembly including plug and receptacle connectors coupled to electrical power lines and embodying the concepts of the invention.

Referring to the drawings in greater detail, and first to FIG. 1, an electrical connector assembly, generally designated 10, includes a plug connector, generally designated 12, and a receptacle connector, generally designated 14.

Plug connector 12 includes a dielectric housing 16 having plug portions 16*a* insertable into receptacles 18*a* of a dielectric housing 18 of receptacle connector 14. A pair of female or socket contacts 20 are mounted within a pair of cavities 22 in plug connector housing 16. The socket contacts are of conventional configuration and may include locking tabs 24 for locking the contacts within the housing and contact dimples or bosses 26 which engage mating contact pins of receptacle connector 14, as described hereinafter. Socket contacts 20 are crimp-type terminals having crimping portions 28 for crimping onto the conductors of bifurcated branch portions 30 of a power line 32. In other words, both socket contacts 20 are electrically connected directly to power line 32. It should be noted that both socket contacts 20 are of equal lengths in the mating direction indicated by arrows "A".

Receptacle connector 14 includes a pair of pin terminals 34 mounted within a pair of cavities 36 in dielectric housing 18, the terminals including terminal pins 38*a* and 38*b*. Like socket contacts 20 of plug connector 12, pin terminals 34 are of the crimp-type and include crimping portions 40 for crimping onto the conductors of bifurcated branch portions 42 of a power line 44. In other words, both pin terminals 34 are electrically connected directly to power line 44. It should be noted that pin contact 38*a* is longer than pin contact 38*b* in the mating direction as indicated by arrows "A".

With the above description of electrical connector assembly 10, it can be understood that, since socket contacts 20 are of equal length and since pin contact 38*a* is longer than pin contact 38*b*, when plug and receptacle connectors 12 and 14, respectively, are initially mated, pin contact 38*a* will be the first-to-engage contact with its respective socket contact (i.e. the top socket contact 20 as viewed in FIG. 1). When initial contact is made, electrical arcing may occur. However, since pin contact 38*a* and its respective socket contact 20 are electrically connected to power lines 44 and 32, respectively, electrical current is established between the power lines. When shorter pin contact 38*b* engages its respective socket contact 20, there will be no electrical arcing. As a result, contact deterioration due to electrical arcing is restricted to longer pin contact 38*a* while the integrity of shorter pin contact 38*b* is maintained. In essence, pin contact 38*a* and its respective socket contact are considered "sacrificial"]contacts to maintain the integrity of pin contact 38*b* and its respective socket contact. With this arrangement, all of the contacts can be fabricated of relatively inexpensive material, such as a brass base material with the contact engaging portions thereof being plated with tin.

Figure 2:
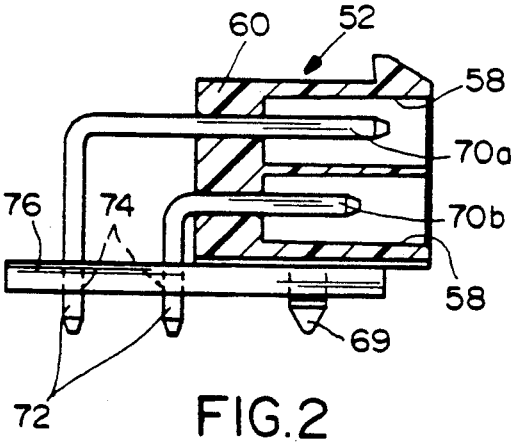
FIG. 2 is an axial section through an embodiment of a receptacle connector embodying the concepts of the invention electrically coupled to a printed circuit board.
Figure 4:
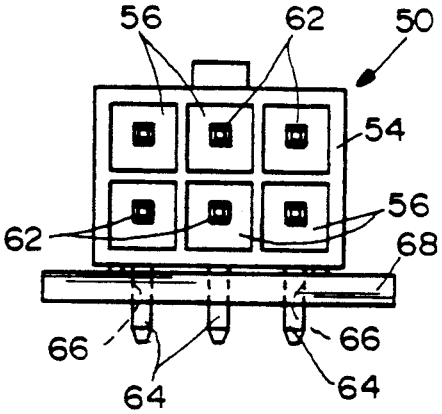
FIG. 4 is an end elevational view of a plug connector for mating with the receptacle connector of FIG. 2.
Figure 3:
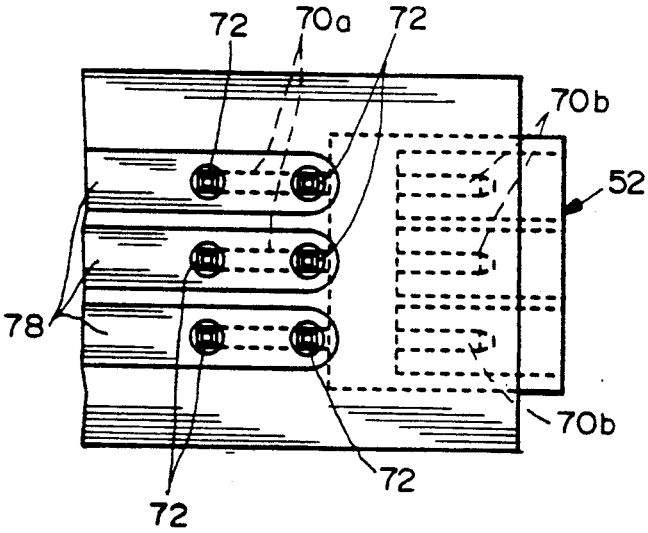
FIG. 3 is a top plan view of the assembly of FIG. 2.

FIGS. 2–4 show another embodiment of the invention wherein pin and socket contacts are used for electrical connection to printed circuit boards More particularly, a plug connector, generally designated 50 (FIG. 4), would correspond to plug connector 12 of electrical connector assembly 10 in FIG. 1. Likewise, a receptacle connector, generally designated 52 (FIGS. 2 and 3), would correspond to receptacle connector 14 of connector assembly 10 in FIG. 1.

With that understanding, plug connector 50 includes a dielectric housing 54 having plug portions 56 insertable into receptacles 58 of a dielectric housing 60 of receptacle connector 52. As with plug connector 12, plug connector 50 includes a plurality of socket contacts 62 mounted within dielectric housing 54, the socket contacts being arranged in pairs. For instance, FIG. 4 shows three pairs of socket contacts arranged horizontally. Like socket contact 20 of plug connector 12, socket contacts 62 all are of equal length in the mating direction. Socket contacts 62 have solder tail portions 64 insertable through respective holes 66 in a printed circuit board 68, with the solder tail portions of each contact pair being soldered to a common circuit trace on the board or in the holes. One or more mounting pegs 69 project from the bottom of dielectric housing 60 for insertion into respective mounting holes in the printed circuit board.

Receptacle connector 52 (FIG. 2) includes pairs of pin contacts 70*a* and 70*b* having solder tail portions 72 for insertion into respective holes 74 in a printed circuit board 76, with the solder tail portions of each contact pair being soldered to a common circuit trace on the board or in the holes.

The concepts of the invention as applied to the embodiment shown in FIGS. 2–4 are the same as described above in relation to electrical connector assembly 10 in FIG. 1. Specifically, it can be seen in FIG. 2 that upper pin contact 70*a* is longer than lower pin contact 70*b*. This is true for each pair of pin contacts horizontally of the connector regardless of the density of the connector. As stated above, socket contacts 62 of plug connector 50 (FIG. 4) are of equal lengths in the mating direction.

Referring to FIG. 3, it can be seen that the pin contacts 70*a* and 70*b* of each pair thereof are coupled to a common circuit trace 78 on printed circuit board 76. This is the same direct electrical connection concept as described above in connecting pin contact 38*a* and 38*b* (FIG. 1) directly through branch portions 42 to common power line 44. Solder traces 78 comprise the power lines for printed circuit board 76. In a similar fashion, although not shown, socket contacts 62 (FIG. 4) of each vertical pair thereof are electrically coupled through their respective solder tails to respective common circuit traces on printed circuit board 68.

At this point, it should be noted that, although FIG. 1 shows only single pairs of pin contacts 38*a*, 38*b* and socket contacts 20, and although FIGS. 2–4 show three pairs of pin contacts 70*a*, 70*b* and socket contacts 62, high density electrical connectors can be designed in accordance with the concepts of the invention and having a high number of pairs of pin and socket combinations.

Figure 5:
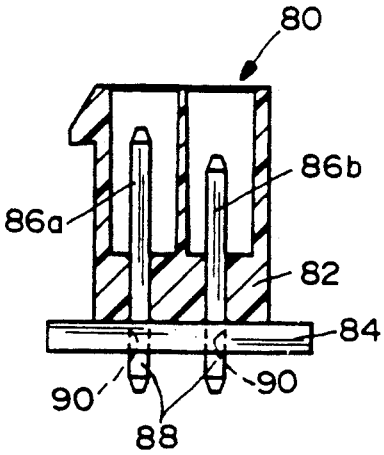
FIG. 5 is an axial section through a further embodiment of the invention, disclosed in a receptacle connector adapted to mount in a vertical orientation on a printed circuit board.

Lastly, FIG. 5 simply shows a receptacle connector, generally designated 80, which includes a dielectric housing 82 mounted in a "vertical" orientation on a printed circuit board 84. In other words, this differs from the right-angled mounting of receptacle 52 to printed circuit board 76 as shown in FIG. 2. Housing 82 mounts a pair of pin contacts 86*a* and 86*b* which have solder tail portions 88 extending through respective holes 90 in printed circuit board 84 for soldering to a common circuit trace on the board or in the holes. It should be noted that pin contact 86*a* is longer than pin contact 86*b*. Consequently, receptacle connector 80 will function the same as receptacle connector 14 (FIG. 1) and receptacle connector 52 (FIG. 2) when mating with a complementary plug connector having socket contacts of equal lengths in the mating direction. Longer pin contact 86*a* will be the first-to-engage pin contact with its respective socket contact and becomes the "sacrificial" contact to protect the integrity of shorter pin contact 86*b* and its respective socket contact.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly which includes a pair of mating dielectric housings, a first pin contact mounted on one of the housings, a first socket contact mateable with the first pin contact and mounted on the other of the housings, the first pin and socket contacts being connected to respective power lines, wherein the improvement comprises a second sacrificial pin contact mounted on the one housing and connected directly to the power line of the first pin contact, a second sacrificial socket contact mounted on the other housing and mateable with the second pin contact and connected directly to the power line of the first socket contact, and the second pin and socket contacts being configured to make mating electrical engagement with each other before the first pin and socket contacts when the housings are moved toward each other in a mating direction, whereby contact deterioration due to electrical arcing is restricted to the second contacts while the integrity of the first contacts is maintained.

2. In an electrical connector assembly as set forth in claim 1, wherein each of said power lines having a bifurcated branch portion and said first and second pin and socket contacts comprise crimp-type terminals crimped to said bifurcated branch portions of the respective power lines.

3. In an electrical connector assembly as set forth in claim 1, wherein said first and second socket contacts are of equal length in the mating direction, and said second pin contact is longer than the first pin contact.

* * * * *